US005299643A

United States Patent [19]

Vetter et al.

[11] Patent Number: 5,299,643

[45] Date of Patent: Apr. 5, 1994

[54] DUAL RADIALLY LOCKED SUBSEA HOUSING

[75] Inventors: Vincent H. Vetter, Spring; Shiva P. Singeetham, Houston; William A. Valka, Spring; Michael R. Williams, Houston, all of Tex.

[73] Assignee: FMC Corporation, Chicago, Ill.

[21] Appl. No.: 968,755

[22] Filed: Oct. 30, 1992

[51] Int. Cl.[5] ..... E21B 33/035

[52] U.S. Cl. ..... 166/368; 166/115; 166/191

[58] Field of Search ..... 166/82, 208, 342, 88, 166/115, 191, 368

[56] References Cited

U.S. PATENT DOCUMENTS

| | | | |
|---|---|---|---|
| 4,641,708 | 2/1987 | Wightman | 166/208 |
| 4,665,979 | 5/1987 | Boehm, Jr. | 166/208 |
| 4,719,971 | 1/1988 | Owens | 166/191 |
| 4,751,968 | 6/1988 | Ames et al. | 166/368 |
| 5,060,724 | 10/1991 | Brammer et al. | 166/208 |
| 5,076,356 | 12/1991 | Reimert | 166/115 |
| 5,103,915 | 4/1992 | Sweeney et al. | 166/82 |
| 5,193,616 | 3/1993 | Hynes | 166/208 |
| 5,224,715 | 7/1993 | Downes et al. | 166/88 |

*Primary Examiner*—Ramon S. Britts

*Assistant Examiner*—Frank S. Tsay

*Attorney, Agent, or Firm*—Lawrence Cruz; Richard B. Megley

[57] ABSTRACT

A radially locked subsea housing includes a low pressure housing having upper and lower radial lock regions, each of which regions includes a radial interference surface that is between vertical to only slightly tapered in orientation. A high pressure housing also has upper and lower radial lock regions, each of which regions includes a radial interference surface that is slightly greater in radial diameter than the corresponding interference surface of the low pressure housing. The interference surfaces of the upper and lower radial lock regions form upper and lower interference fits, respectively, between the high pressure and low pressure housings when the housings are assembled subsea. The low pressure housing further includes a landing shoulder defining a landing surface that is substantially more tapered in orientation than are the interference surfaces of the upper and lower radial lock regions, and the high pressure housing includes a landing shoulder defining a landing surface formed to land on the landing surface of the low pressure housing when the housings are assembled subsea. In an alternative embodiment, a zero-clearance, axially extended fit is employed at one or both of the radial lock regions.

24 Claims, 5 Drawing Sheets

FIG_7
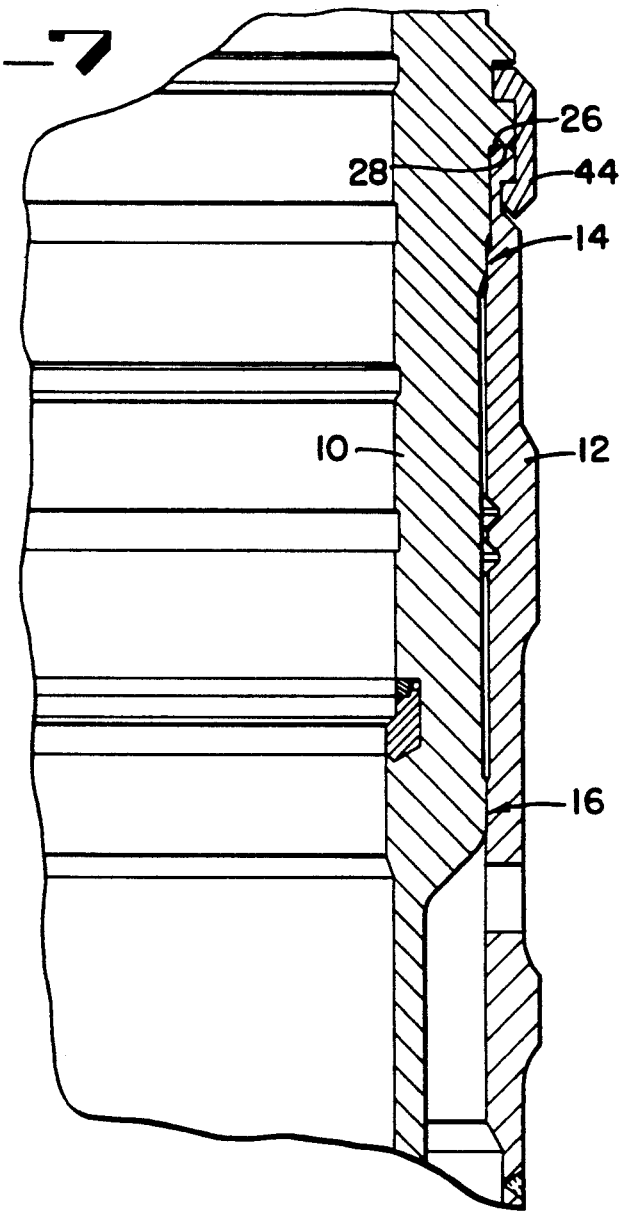
FIG_8
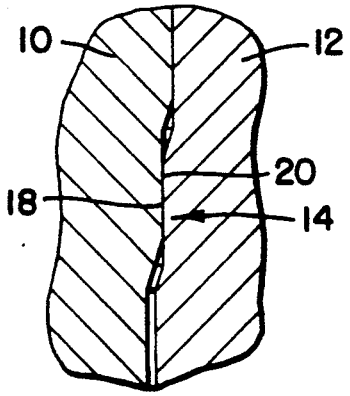
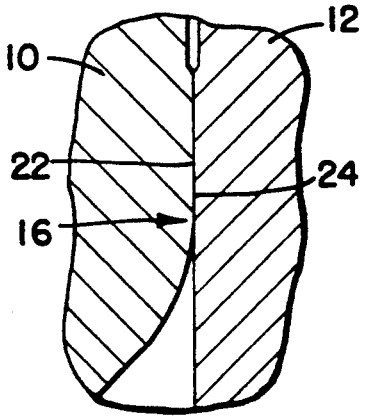
FIG_9

DUAL RADIALLY LOCKED SUBSEA HOUSING

BACKGROUND OF THE INVENTION

This invention relates to improved rigid, dual radially locked subsea wellhead housings used in offshore drilling.

Early subsea wellhead system designs remained essentially unchanged for many years, typically employing a single landing or support shoulder between the 18¾" high pressure wellhead housing (referred to below as "the HP housing") and the 30" conductor housing (referred to below as "the LP housing"). This type of load-transfer mechanism operated relatively well for many years, until field failures occurred in the early 1980's while operating in high current situations. Subsequent studies revealed that external loadings, such as those generated by drilling risers or platform tiebacks, caused bending stresses in the casing extension below the HP housing, ultimately resulting in a fatigue failure of the weld between the casing and the bottom of the HP housing body. Numerous studies indicated that the magnitudes of the bending stresses in the extension below the HP housing were affected by several factors, including: (1) the type of interface between the HP and LP housings; (2) the radial clearances between the HP and LP housings; (3) the cement level in the annulus between the conductor pipe and casing extension below the HP housing; (4) the size of the wellhead extension; and (5) the external load.

As a result of the field failures and subsequent studies, the interface between the HP housing and the LP housing underwent several design changes. The end goal of most of the design efforts has been to eliminate fatigue failure in the casing immediately below the HP housing by increasing the rigidity between the HP and LP housings so that external loads imposed on the HP housing are more directly and efficiently transferred to the LP housing. Most designs implemented dual, axially spaced, sockets and a beveled landing shoulder at the interface between the HP and LP housings. However, prior "dual socket" designs included relatively high degrees of taper on the opposing interface elements, and require significant axial (or downward) force to keep the tapered elements in proper relative position so that the radial component of the tapers is maintained during load transfer. In other words, if vertical motion is present in the dual socket designs, the tapered sections of the landing shoulders can become misaligned, providing an increased radial separation or clearance between the HP and LP housings, resulting in decreased radial rigidity and greater potential for fatigue-related failure.

Thus, in order to maintain radial rigidity in such designs, it is also necessary to maintain axial rigidity. Therefore, significant attention is directed in such designs to providing means for maintaining axial rigidity to eliminate vertical movement between the HP and LP housings, often resulting in the use of complicated wedges or unidirectional latches. Further, as a consequence of meeting the goals of increasing both radial and axial rigidity, recent designs have resulted in complicated installation and locking procedures, often requiring the use of significant amounts of preload and expensive and cumbersome tools and camming devices. Moreover, once installed and used in accordance with such prior designs, the housings were difficult to refurbish and reuse.

Accordingly, there is a need for significantly improved radial lock designs for subsea housings that are effective simple to install, maintain and refurbish.

SUMMARY OF THE INVENTION

It is an object of the invention to provide improved radial lock designs for subsea housings that are effective, and simple to install.

It is another object of the invention to provide improved designs for subsea housings that achieve increased radial rigidity throughout a relatively high degree of axial or vertical movement.

It is another object of the invention to provide improved designs for subsea housings that efficiently transfer radial loads from the HP housing to the LP housing without requiring a high degree of axial rigidity.

It is another object of the invention to improve the fatigue strength of well head housings.

It is another object of the invention to provide improved designs for subsea housings that increase radial rigidity while at the same time simplifying installation procedures.

It is another object of the invention to provide improved designs for subsea housings that increase radial rigidity and can be installed using primarily the weight of the HP housing assembly.

It is another object of the invention to provide improved designs for subsea housings that achieve high radial rigidity and include means for easily refurbishing a used HP housing to reestablish proper critical dimensions.

The above and other objects are achieved in an improved radially locked subsea housing assembly wherein a LP housing includes upper and lower radial lock regions, each of which regions includes a radial interference surface that is substantially vertical in orientation. A HP housing also includes upper and lower radial lock regions, each of which regions has a radial interference surface that is slightly greater in radial diameter than the corresponding interference surface of the LP housing. The interference surfaces of the upper and lower radial lock regions form upper and lower interference fits, respectively, between the HP and LP housings when the housings are assembled. The LP housing further includes a landing shoulder defining a landing surface, which is substantially more tapered in orientation than are the interference surfaces of the upper and lower radial lock regions. The HP housing also includes a landing surface formed to seat on the landing shoulder of the LP housing when the housings are assembled subsea. The radial interference surfaces of the upper and lower radial lock regions of the HP and LP form axially extended interference fits, which allow a significant amount of axial travel without separating or causing radial clearance. An annular axial lock is coupled near the top of the HP and LP housings when assembled subsea for limiting axial movement between the HP and LP housings to an amount less than the extended length of the interference fits at the upper and lower radial lock regions.

The above and other objects are also achieved by an improved dual radially locked subsea housing having upper and lower radial lock regions forming upper and lower interference fits. The upper radial lock region of the LP housing includes a relatively thin-walled section formed by hollowing a portion of the LP housing near the interference fit. Further, the lower radial lock region of the HP housing includes a barrel spring retained in a seat, wherein the barrel spring is compressed to form at least a portion of the lower interference fit as the HP and LP housings are assembled subsea. By using a thin-walled section in the upper radial lock and a barrel spring in the lower radial lock, the HP and LP housings can be easily assembled using primarily the weight of the HP housing.

The above and other objects are also achieved by a radially locked subsea housing wherein the HP housing optionally includes a removable wear ring retained in and forming part of either the upper or lower interference fit between the HP and LP housings. The removable wear rings can be replaced with new rings to refurbish a used HP housing to proper tolerances.

The above and other objects are further achieved by a dual radially locked subsea housing wherein the LP housing includes barrel spring insert sleeve retained therein and forming at least a portion of the interference fits in both upper and lower radial lock regions. The insert sleeve includes a relatively thin-walled main sleeve formed of sufficient length to interface both the upper and lower radial lock regions of the HP and LP housings. An upper barrel spring is formed at the top section of the sleeve near the upper radial lock regions. A lower barrel spring is formed at the bottom section of the sleeve near the lower radial lock regions. A retainer, such as a bolt, holds the sleeve in place as the HP and LP housings are assembled. The upper and lower barrel springs of the sleeve are compressed by the interference surfaces of the HP housing when the housings are assembled, thereby forming a dual-radial interference fit. Again, by using barrel springs at both the upper and lower interference fits, the HP and LP housings can be assembled using primarily the weight of the HP housing.

The above and other objects are also achieved by a dual radially locked subsea housing having a HP housing locked within a LP housing at upper and lower radial lock regions. An axial lock between the HP and the LP housings limits relative axial movement between the housings to a predetermined maximum, and further, transfers axial loads from the HP housing to the LP housing. At least one radial lock region is defined by a substantially vertical radial interference fit extending in the axial direction. The second radial lock region of the LP housing including a radial reaction surface having a defined inner diameter, while the HP housing includes a ring retained in a seat and having teeth or projections at its periphery. The teeth of the ring extend to a radial outer diameter greater than the defined inner diameter of the reaction surface of the second radial lock region of the LP housing. The LP housing includes means for cutting the extended teeth of the ring to the defined inner diameter of the reaction surface of the second radial lock region of the LP housing as the housings are assembled, thereby forming a substantially vertical, radial, zero-clearance fit between the HP and LP housings at the second radial lock region. In this embodiment, the second radial lock serves to compensate for manufacturing clearances by cutting or shearing the teeth of the ring to an exact fit. If desired, the first radial lock region can also be formed by employing a substantially vertical, radial, zero-clearance fit between the HP and LP housings.

Thus, as discussed in greater detail below, by using various combinations and types of two relatively extended and straight-bore interference (or zero-clearance) fits between the HP and LP housings, radial rigidity is achieved without the necessity of a highly rigid axial fit. With a sufficiently long straight bore, the system can tolerate a relatively large amount of relative vertical movement between the HP and LP housings as compared to prior "dual socket" systems, while still maintaining radial rigidity. By properly combining the interference fit, variable housing wall thicknesses, and, if desired, selected low-friction coatings, the improved design can handle realistic loads, and yet the HP housing can still be assembled subsea into the LP housing using only the weight of the casing and HP housing ("weight set"). This improved design separates the requirements of radial and axial rigidity, provides increased radial rigidity over a wider degree of axial movement, and eliminates expensive and cumbersome installation procedures.

Other aspects of the invention will be appreciated by those skilled in the art after reviewing the following detailed description of the invention.

BRIEF DESCRIPTION OF THE DRAWINGS

The invention, together with its objects and advantages, will be better understood after referring to the following description and the accompanying figures. Throughout the figures, a common reference numeral is intended to refer to the same element.

FIG. 7 is a vertical elevation view of another embodiment of the invention employing upper and lower regions of interference fit and a LP housing with relatively thin wall structure at the regions of interference.

FIG. 8 is a detail view of the upper interference fit of FIG. 7.

FIG. 9 is a detail view of the lower interference fit of FIG. 7.

DETAILED DESCRIPTION

Figure 1:
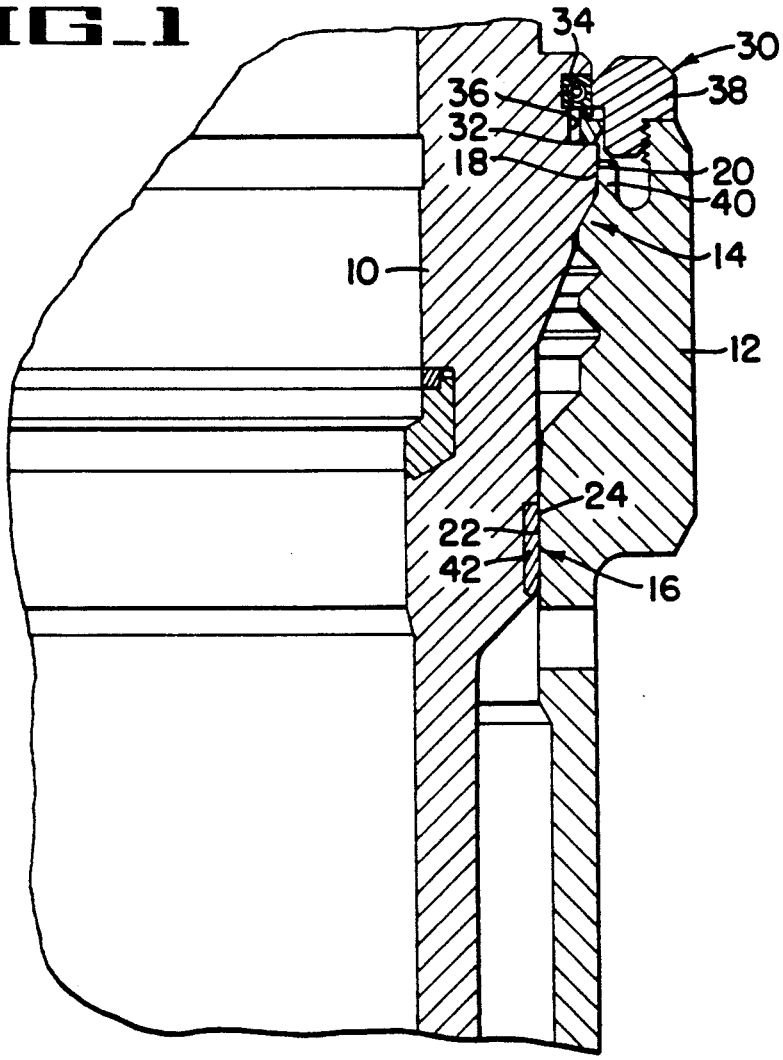
FIG. 1 is a vertical elevation view of a preferred embodiment of the invention having a top interference fit above the landing seat and below an annular lock spring.
Figure 2:
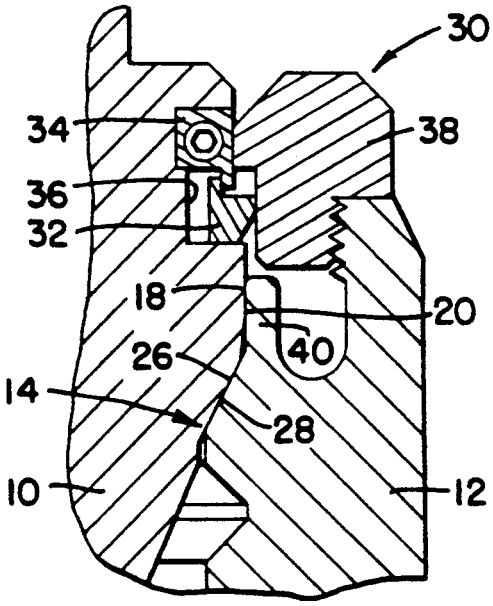
FIG. 2 is a detail view of the top interference fit of FIG. 1.
Figure 3:
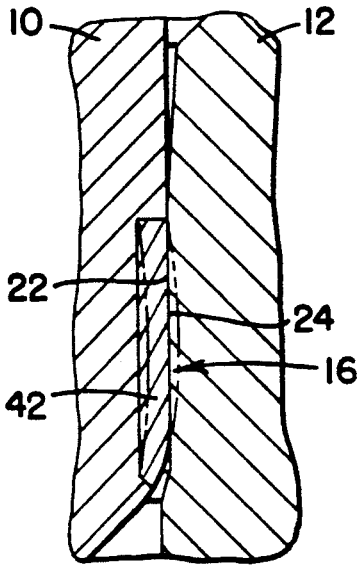
FIG. 3 is a detail view of the bottom interference fit of FIG. 2 including a barrel spring.

A high pressure housing ("HP housing") 10 is shown in FIG. 1 assembled within a low pressure housing ("LP housing") 12 in accordance with the improved dual-point, radial lock design of the present invention. Typically, the LP housing 12 is coupled to a permanent guide base, or "PGB" (not shown) in a manner well known to those skilled in the art. Shown in FIGS. 2 and 3, respectively, are upper and lower radial lock regions 14 and 16 of the HP and LP housings 10 and 12. The upper radial lock region 14 of the LP housing 12 includes on a portion of its inner diameter a substantially vertically oriented radial interference surface 18. Similarly, the upper radial lock region 14 of the HP housing 10 includes on a portion of its outer diameter a substantially vertical radial interference surface 20, which is slightly greater in radial diameter than the corresponding inner diameter of interference surface 18 of the LP housing 12. Referring to FIG. 3, the lower radial lock region 16 of the LP housing 12 also includes on a portion of its inner diameter a substantially vertically oriented radial interference surface 22. As with the upper radial lock region 14, the lower radial lock region 16 of the HP housing 10 includes on a portion of its outer diameter a substantially vertical radial interference surface 24 that is slightly greater in radial diameter than the corresponding interference surface 22 of the LP housing 12. Thus, when the HP housing 10 is assembled subsea within the LP housing 12, the respective interference surfaces of the housings are forced into an interference fit, thereby forming the upper and lower radial locks 14 and 16 between the housings.

The LP housing 12 includes a landing shoulder or surface 26 that is substantially more angled relative to the vertical axis than are the interference surfaces of the upper and lower radial locks 14 and 16. Likewise, the HP housing 10 includes a landing face or surface 28 tapered to seat or otherwise land upon the landing surface 26 of the LP housing 12. During assembly of the housings, when the landing surface 28 of the HP housing 10 seats or lands upon the landing surface 26 of the LP housing 12, the HP housing 10 is fully inserted within the LP housing 12. Additionally, axially loads are transferred from the HP housing 10 to the low pressure housing through the landing shoulder 26.

As indicated, the interference surfaces of the upper and lower radial locks 14 and 16 are relatively vertical in axial orientation, and also relatively extended in length, when compared to the tapered sockets of prior designs. As a result, the interference fits themselves are likewise relatively extended in axial length. Accordingly, unlike prior designs, where only minimal vertical or axial movement resulted in the tapered sockets becoming unseated, the relatively extended length of the interference fits of the present invention can tolerate a relatively large amount of vertical or axial movement without resulting in radial clearance between the housings. Moreover, it should be clear that, although the preferred embodiment employs relatively vertically oriented interference surfaces, very slightly tapered interference surfaces could also be employed. However, as the taper increases, greater force is necessary to create the interference fits, and further, the axial length of the interference fits shortens. Thus, with increasing taper, the effectiveness of the invention decreases. Testing and experimentation has demonstrated that effective, relatively long interference fits can be achieved by maintaining the taper within a range of $\pm 3$ degrees, but preferably as close to vertical as possible. Under such conditions, the system can be easily installed using only the weight set of the housing and the casing, while still maintaining long interference acts.

Although the improved interference fits tolerate greater relative axial movement between the housings, it is still preferred that an axial spring lock 30 be employed to reasonably limit such relative axial travel to a predetermined maximum that is less than the length of the interference fits. In one form, the axial lock includes an annular spring 32 held by a spring retainer 34 in a recessed groove 36 near the top of the HP housing 10. Further, a threaded annular lock ring 38 fitted near the top of the LP housing 12 cooperates with the annular spring 32 to prevent or limit relative axial travel between the assembled housings. More particularly, as the HP housing 10 is inserted within the LP housing 12, the annular spring 32 is compressed by the leading top surface of the annular lock ring 38. As the HP housing 10 lands or seats within the LP housing 12, the annular spring 32 clears the trailing ledge of, and is spring-locked beneath, the lock ring 38.

In general, numerous dual radial lock designs can be implemented using upper and lower interference fits, several of which are shown in the remaining figures and discussed below. However, as shown in FIGS. 1 through 3, the preferred design implements in the LP housing 12 a landing shoulder 26 that is axially positioned between the upper and lower interference fits. Moreover, the upper interference surface 18 of the LP housing 12 includes a relatively thin-walled section 40 formed by hollowing out a portion of the LP housing 12 behind the interference surface 18. The lower interference surface 24 of the HP housing 10 includes a "barrel spring" 42 installed on its outside diameter. The barrel spring 42 is a continuous ring that has a curved wall section similar to that of a barrel. The ring is installed onto the HP housing 10 during manufacture so that one or both ends of the barrel spring 42 have an interference fit with the outer diameter of the HP housing 10, but there is clearance between the barrel spring 42 and the HP housing 10 between the ends. Further, the middle of the barrel spring 42 has a larger outside diameter than the inner diameter of the interference surface 22 of the LP housing 12. Thus, when the HP housing 10 is lowered into the LP housing 12, the barrel spring 42 is deformed by the lower interference surface 22.

By using a relatively thin-walled interference surface 18 and structure 40 for a portion of the upper interference fit, and a barrel spring 42 for a portion of the lower interference fit, it is possible to assemble the housings subsea without using cumbersome, expensive or complicated tools, and further, using only the weight of the HP housing 10. This proves to be a great advantage over prior dual-point, radial locks systems.

Figure 4:
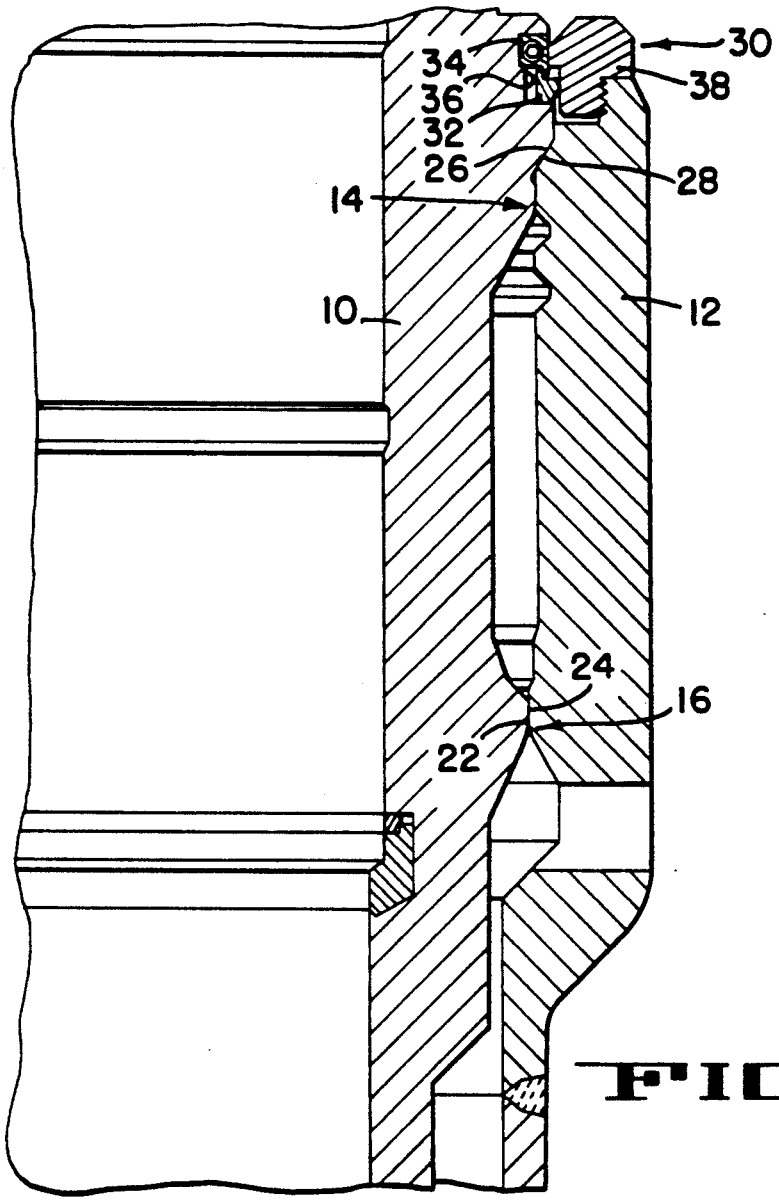
FIG. 4 is a vertical elevation view of one embodiment of the invention employing upper and lower regions of interference fit, and including a landing shoulder near the upper interference fit.
Figure 5:
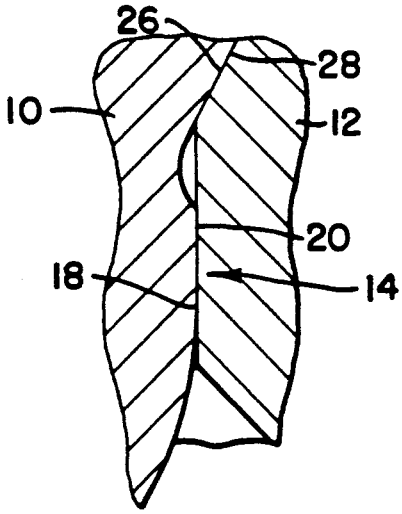
FIG. 5 is a detail view of the upper interference fit of FIG. 4.
Figure 6:
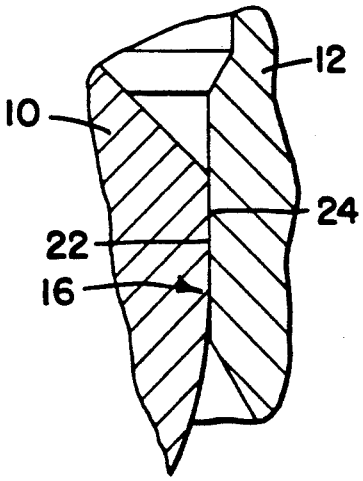
FIG. 6 is a detail view of the lower interference fit of FIG. 4.

Shown in FIGS. 4 through 6 is an alternative embodiment of the invention in which the landing shoulder is positioned above the upper radial lock region 14. In this embodiment, it is not necessary or beneficial to hollow out the area behind the upper interference surface 18 of the LP housing 12 to form a thin-walled interference surface. Thus, relatively thick-walled housings are employed as compared to the relatively thin-walled structures of FIGS. 1 through 3. However, because a thick-walled structure is employed at the radial lock regions 14 and 16, it is preferred to use alternative material or coating selections to facilitate installation procedures. For example, an overlay coating of low friction material (such as Teflona) can be used at the areas of the interference surfaces. In addition, the low pressure housing can be formed at the region of the interference surface of a composite material having anisotropic properties, thereby allowing low insertion forces while maintaining resistance against external loading.

FIGS. 7 through 9 depict another thin-walled housing assembly. The LP housing 12 is shown having a thin wall of approximately 2 inches, with relatively vertical straight-bore upper and lower radial interference fits between the HP and LP housings 10 and 12. The embodiment differs from that of FIGS. 1 through 3 in two primary ways. First, the weight of the HP housing 10 is axially loaded into the top of the LP housing 12. In other words, instead of an angled landing shoulder, the top of the LP housing 12 includes a relatively flat landing shoulder 26 upon which seats the flat similarly landing face 28 of the HP housing 10. Second, instead of the three piece axial lock 30 of FIGS. 1 through 3, a simple external snap ring 44 locks the two housings together to prevent the HP housing 10 from being pulled accidentally from the interference fits with the LP housing 12. Because of the relatively thin-walled structure of the LP housing 12, a relatively small amount of weight is required to assemble the HP housing 10 into the LP housing 12. Additionally, wall thickness is less of a factor if the interference fit is at the end of the housing, such as at the top interference fit of FIG. 7. This is so because the end of the housing is easier to force open than is the central areas further remove from the end, which central areas are braced by material on both sides.

Figure 10:
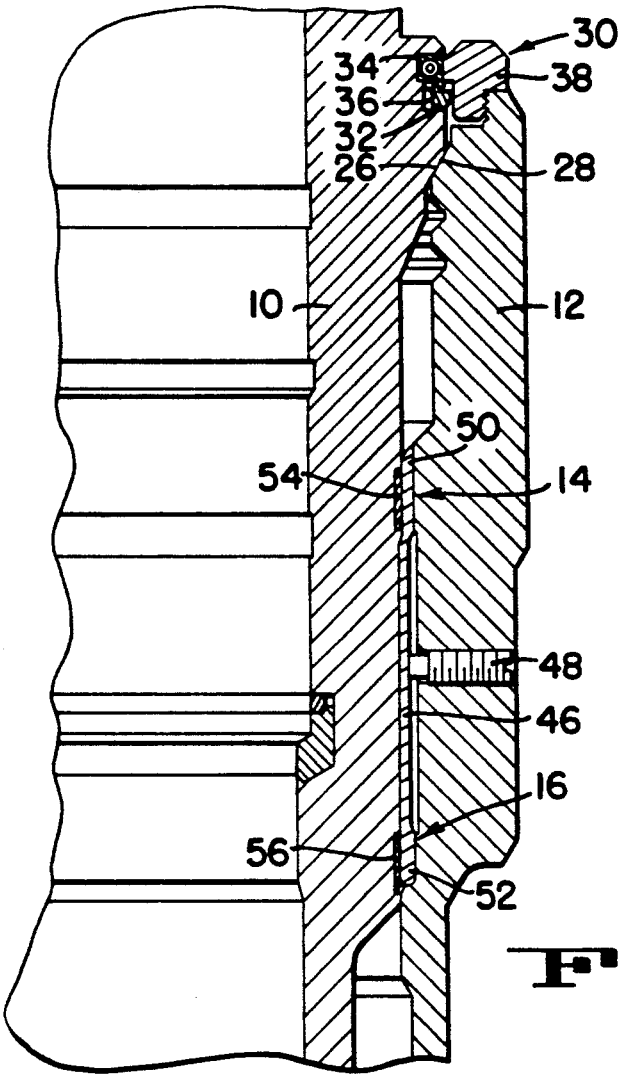
FIG. 10 is a vertical elevation view of another embodiment of the invention including wear rings on the HP housing.
Figure 11:
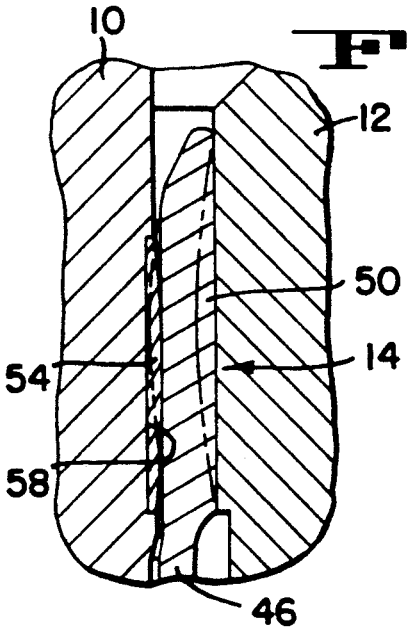
FIG. 11 is a detail view of the upper wear ring of FIG. 10.
Figure 12:
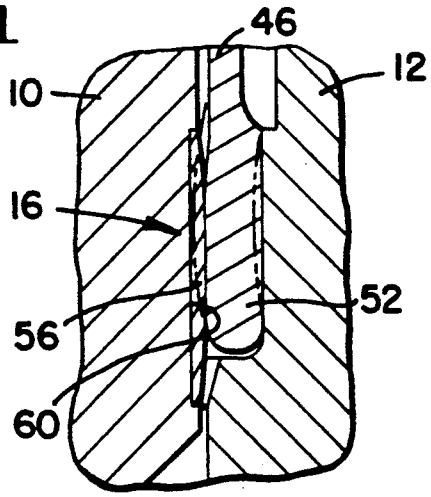
FIG. 12 is a detail view the lower wear ring of FIG. 10.

Yet another embodiment of the invention is shown in FIGS. 10 through 12. In this embodiment, both the HP and LP housings 10 and 12 are themselves relatively thick-walled structures which are capable of handling relatively large loads. An angled or tapered landing shoulder 26 exists at the top of the LP housing 12, along with a three-piece axial lock, much like that of FIG. 1. A thin wall sleeve 46, which is free at both ends, is coupled to the LP housing 12 during manufacture using, for example, a retainer bolt 48. As shown in FIGS. 11 and 12, each end of the sleeve 46 includes a barrel spring 50, 52 similar to the barrel spring 42 of FIGS. 1 and 3. The barrel spring ends 50 and 52 of the sleeve 46 serve to reduce the inner diameter of the interference surface of the LP housing 12 to an amount sufficient to form an interference fit with the outer diameter of the interference surface of the HP housing 10. Because of the relatively thin-walled sleeve 46, the HP housing 10 can be "weight set" assembled into the sleeve 46 forming relatively straight-bore interference fits.

Also shown in FIGS. 10 through 12 are optional wear rings 54 and 56 on the HP housing 10 at the regions of the interference fits. The wear rings 54 and 56 can be installed in retaining grooves 58 and 60, respectively, when manufacturing or refurbishing a used HP housing 10 to reestablish the proper critical diameters for the interference fits. Such wear rings 54 and 56 can also be selectively used in various of the other, alternative embodiments of the invention.

Figure 13:
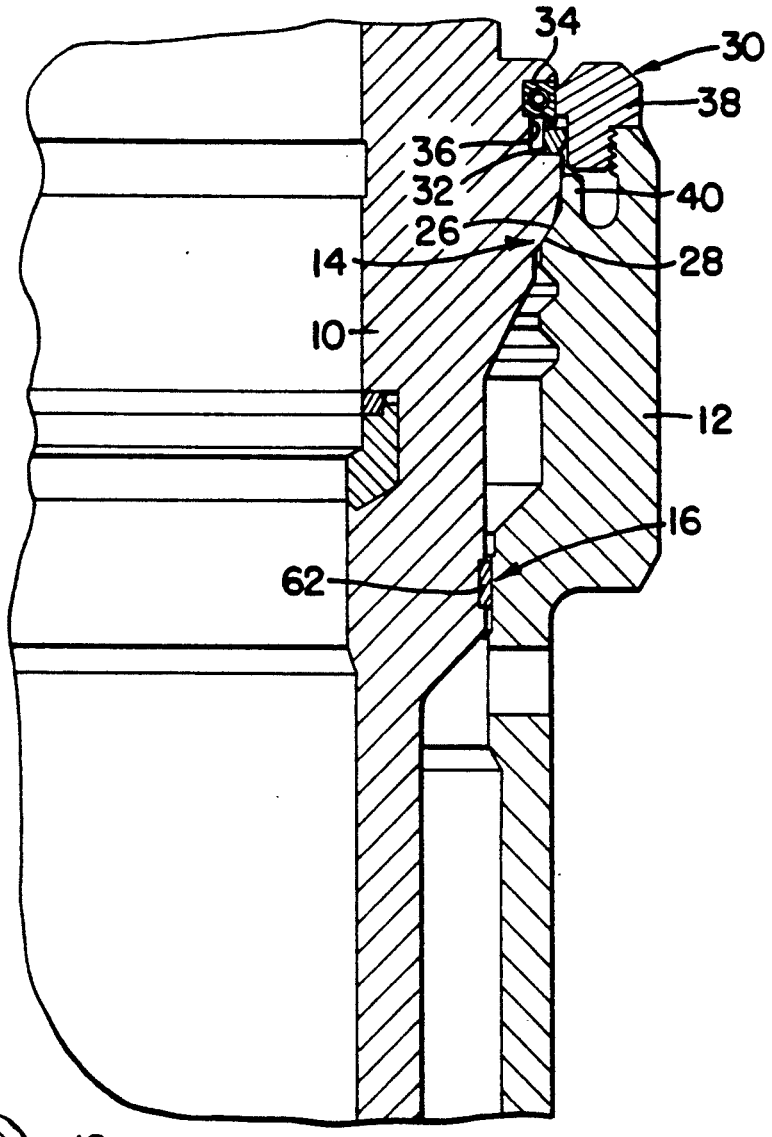
FIG. 13 is a vertical elevation view of an alternative embodiment to FIG. 1 substituting a grooved ring for the barrel spring.
Figure 14:
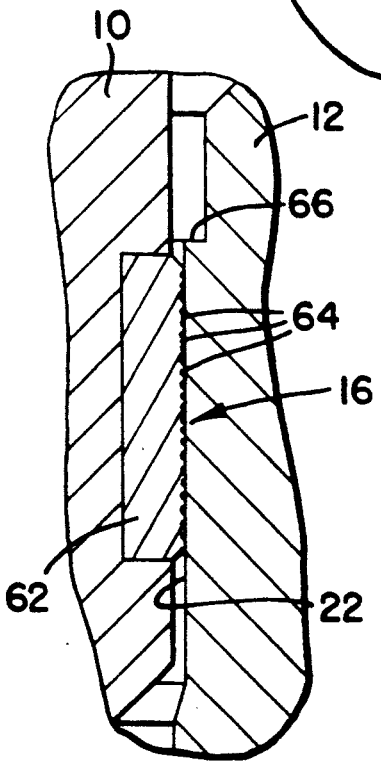
FIG. 14 is a detail view of the lower interference fit of FIG. 13.

Shown in FIGS. 13 and 14 is another embodiment of the invention. In this embodiment, the upper radial lock region 14 includes an interference fit much like that of FIGS. 1 and 2. The landing shoulder 26 is below the interference fit of the upper radial lock region 16, and a three-piece axial lock 30 prevents accidental or excessive relative axial movement between the housings 10 and 12. However, at the lower radial lock region 14, the HP housing 10 includes a ring 62 having multiple small projections or teeth 64 at its periphery, which teeth 64 extend to an outer diameter that is slightly greater than the inner diameter of a reaction surface 22 of the LP housing 12. During installation of the HP housing 10 within the LP housing 12, a cutting shoulder 66 near the top of the lower radial lock region 16 of LP housing 12 shears the projections or teeth 64 of the ring to the same diameter as the inner diameter of the reaction surface 22 of the LP housing 12. That results in an assembly that has zero clearance, but no interference, at the reaction point, regardless of the actual machined dimensions of the components. Accordingly, the lower radial lock 16 of the embodiment of FIG. 13 and 14 does not employ an interference fit, but rather, a zero-clearance fit, while still effectively compensating for manufacturing tolerances of the components. If desired, the interference fit of the upper radial lock region 14 can likewise be formed by a zero-clearance radial fit such as that shown in FIG. 14.

Although the preferred and several alternative embodiments of the invention have been described, it is understood that numerous modifications, variations, and alternative forms and embodiments may be devised without departing from its spirit and scope. For example, while several of the embodiments depict the landing region positioned between the upper and lower radial lock regions, the landing region could also be positioned above the upper lock region or below the lower lock region. Similarly, the various forms of interference fits for the upper radial lock regions could also be implemented in various combinations on the lower radial lock region, and vice-versa.

What is claimed is:

1. A radially locked subsea housing comprising;

(a) a low pressure housing having upper and lower radial lock regions, each of which regions includes a radial interference surface that is substantially vertical in orientation (b) a high pressure housing having upper and lower radial lock regions, each of which regions includes a radial interference surface that is slightly greater in radial diameter than the corresponding interference surface of the low pressure housing, and wherein the interference surfaces of the upper and lower radial lock regions form upper and lower interference fits, respectively, between the high pressure and low pressure housings when the housings are assembled subsea; and (c) wherein the low pressure housing further includes a landing shoulder defining a landing surface that is substantially more tapered in orientation than are the interference surfaces of the upper and lower radial lock regions, and the high pressure housing includes a landing shoulder defining a landing surface formed to land on the landing surface of the low pressure housing when the housings are assembled subsea.

2. A radially locked subsea housing in accordance with claim 1 wherein the radial interference surfaces of the upper and lower radial lock regions of the high and low pressure housings are extended in length to form axially extended interference fits therebetween.

3. A radially locked subsea housing in accordance with claim 2 further comprising an annular lock means for coupling together the high pressure and low pressure housings when assembled subsea and for limiting axial movement between the high and low pressure housings to an amount less than the extended length of the interference fits at the upper and lower radial lock regions.

4. A radially locked subsea housing in accordance with claim 3 wherein the annular lock means comprises:
(a) an annular spring;
(b) spring retainer means for retaining the annular spring in a recessed groove in the high pressure housing; and
(c) an annular lock ring fitted near the top of the low pressure housing and shaped so as to lock with the annular spring after the high pressure housing is inserted and lands within the low pressure housing.

5. A radially locked subsea housing in accordance with claim 1 wherein the upper radial lock region of the low pressure housing comprises a relatively thin-walled structure as compared to the wall structure of the high pressure housing.

6. A radially locked subsea housing in accordance with claim 1 wherein the upper radial lock region of the low pressure housing includes a thin-walled section formed by hollowing out a portion of the low pressure housing behind the interference surface.

7. A radially locked subsea housing in accordance with claim 1 wherein the landing shoulder of the low pressure housing is axially positioned between the upper and lower interference fits.

8. A radially locked subsea housing in accordance with claim 1 wherein at least one radial lock region of the high pressure housing includes a barrel spring retained in a seat, and wherein the barrel spring is compressed to form at least a portion of the interference fit as the high pressure and low pressure housings are assembled subsea.

9. A radially locked subsea housing in accordance with claim 1 wherein the upper radial lock region of the high pressure housing includes a removable wear ring retained therein, which wear ring forms at least a portion of the interference fit with the interference surface of the upper radial lock region of the low pressure housing.

10. A radially locked subsea housing in accordance with claim 1 wherein the lower radial lock region of the high pressure housing includes a removable wear ring retained therein, which wear ring forms at least a portion of the interference fit with the interference surface of the lower radial lock region of the low pressure housing.

11. A radially locked subsea housing in accordance with claim 1 further comprising a thin-walled sleeve retained between the low pressure and high pressure housings for forming at least a portion of the interference fits in both the upper and lower radial lock regions.

12. A radially locked subsea housing in accordance with claim 11 wherein the thin-walled sleeve is formed of sufficient length to interface both the upper and lower radial lock regions of the high and low pressure housings, and further comprises:
(a) an upper barrel spring formed at the top section of the sleeve near the upper radial lock regions;
(b) a lower barrel spring formed at the bottom section of the sleeve near the lower radial lock regions;
(c) means for holding the sleeve in place as the between the high and low pressure housings are assembled; and
(d) wherein the upper and lower barrel springs of the sleeve are compressed by the interference surfaces of the high and low pressure housings when the housings are assembled.

13. A radially locked subsea housing in accordance with claim 1 wherein the interference surfaces of the upper and lower radial lock regions of the high pressure and low pressure housings are each extended in axial length so as to remain substantially in interference contact with one another throughout the full range of relative axial movement between the housings.

14. A dual radially locked subsea housing comprising:
(a) a high pressure housing assembled within a low pressure housing;
(b) upper and lower radial locks between the high pressure housing and the low pressure housing, each radial lock being defined by a substantially vertical radial interference fit;
(c) axial lock means between the high pressure and the low pressure housings for limiting relative axial movement between the housings to a predetermined maximum; and
(d) the interference fit of the upper and lower radial locks extending a distance in the axial direction greater than the predetermined maximum for allowed relative axial movement between the housings.

15. A dual radially locked subsea housing in accordance with claim 14 wherein the axial lock means comprises:
(a) an annular spring;
(b) spring retainer means for retaining the annular spring in a recess in the high pressure housing; and
(c) an annular lock ring fitted near the top of the low pressure housing and shaped so as to lock with the annular spring after the high pressure housing is inserted and lands within the low pressure housing.

16. A dual radially locked subsea housing in accordance with claim 14 wherein the upper radial lock region of the low pressure housing includes an interference surface formed on the inner diameter of a thin-walled section of the low pressure housing.

17. A dual radially locked subsea housing in accordance with claim 14 wherein the upper radial lock of the low pressure housing includes a relatively thin-walled section formed by hollowing a portion of the low pressure housing behind the interference fit.

18. A dual radially locked subsea housing in accordance with claim 14 wherein the lower radial lock of the high pressure housing includes a barrel spring retained in a seat, and wherein the barrel spring is compressed to form at least a portion of the interference fit as the high pressure and low pressure housings are assembled subsea.

19. A dual radially locked subsea housing in accordance with claim 14 wherein the upper radial lock of the high pressure housing includes a removable wear ring retained therein, which wear ring forms at least a portion of the interference fit with the low pressure housing.

20. A dual radially locked subsea housing in accordance with claim 14 wherein the lower radial lock of the high pressure housing includes a removable wear ring retained therein, which wear ring forms at least a portion of the interference fit with the low pressure housing.

21. A dual radially locked subsea housing in accordance with claim 14 wherein the low pressure housing includes barrel spring sleeve means retained therein for forming at least a portion of the interference fit in both the upper and lower radial locks.

22. An insert sleeve for forming a dual radial interference fit between a low pressure and high pressure housing of a subsea assembly, the dual radial interference fit forming upper and lower radial locks, the insert sleeve comprising:

(a) a thin-walled insert formed of length sufficient to interface both the upper and lower radial locks between the high and low pressure housings;

(b) an upper barrel spring formed at the top section of the sleeve near the upper radial lock;

(c) a lower barrel spring formed at the bottom section of the sleeve near the lower radial lock;

(d) means for holding the sleeve in place as the high and low pressure housings are assembled subsea; and (e) wherein the upper and lower barrel springs of the sleeve are compressed by interference surfaces of the high and low pressure housing as the housings are assembled.

23. A dual radially locked subsea housing comprising:

(a) a high pressure housing locked within a low pressure housing at first and second radial lock regions;

(b) axial lock means between the high pressure and the low pressure housings for limiting relative axial movement between the housings to a predetermined maximum;

(c) a first radial lock region of the high and low pressure housings being defined by a substantially vertical radial interference fit between the housings and extending in the axial direction;

(d) the second radial lock region of the low pressure housing including a reaction surface having a defined inner diameter;

(e) the second radial lock region of high pressure housing including a grooved ring retained in a seat, the ring including teeth extending to a radial diameter greater than the defined inner diameter of the reaction surface of the second radial lock region of the low pressure housing;

(f) wherein the low pressure housing includes means for cutting the extended teeth of the ring to the defined inner diameter of the reaction surface of the second radial lock region of the low pressure housing as the housings are assembled subsea so as to form a substantially vertical, radial, zero-clearance fit between the high and low pressure housings at the second radial lock region; and (g) wherein the radial interference fit of the first radial lock region and the radial exact fit of the second radial lock region each define radial locks that extend in the axial direction an amount greater than the predetermined maximum axial movement allowed by the axial lock.

24. A dual radially locked subsea housing in accordance with claim 23 wherein the means for cutting the extended grooves of the ring comprises a cutting shoulder formed near the top of the second radial lock region of the low pressure housing.

* * * * *